US006382767B1

(12) United States Patent
Greive

(10) Patent No.: US 6,382,767 B1
(45) Date of Patent: May 7, 2002

(54) METHOD AND DEVICE FOR CLEANING A PRINT HEAD OF AN INK JET PRINTER

(75) Inventor: Martin Greive, Schönau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/606,034

(22) Filed: Jun. 28, 2000

(30) Foreign Application Priority Data

Jun. 28, 1999 (DE) ..... 199 29 540

(51) Int. Cl.[7] ..... B41J 2/165
(52) U.S. Cl. ..... 347/30; 347/33
(58) Field of Search ..... 347/30, 31, 32, 347/33, 22, 35

(56) References Cited

U.S. PATENT DOCUMENTS 4,437,105 A * 3/1984 Mrazek et al. ..... 347/33
4,947,190 A * 8/1990 Mizusawa et al. ..... 347/33
5,730,538 A 3/1998 Kato
5,757,387 A * 5/1998 Manduley ..... 347/33
6,206,498 B1 * 3/2001 Kondo et al. ..... 347/33

FOREIGN PATENT DOCUMENTS

EP 0389481 B1 10/1990
EP 0631871 A2 1/1995

* cited by examiner

*Primary Examiner*—Huan Tran
(74) *Attorney, Agent, or Firm*—Herbert L. Lerner; Laurence A. Greenberg; Werner H. Stemer

(57) ABSTRACT

A method for cleaning a print head of an ink jet printer by a cleaning tape, which comprises sucking away printing ink from the print head by a suction device, and wiping or doctoring off the print head by the cleaning tape; a device for performing the method; an ink jet printer in combination with the device; and an offset and/or rotary printing machine in combination with the ink jet printer.

13 Claims, 6 Drawing Sheets

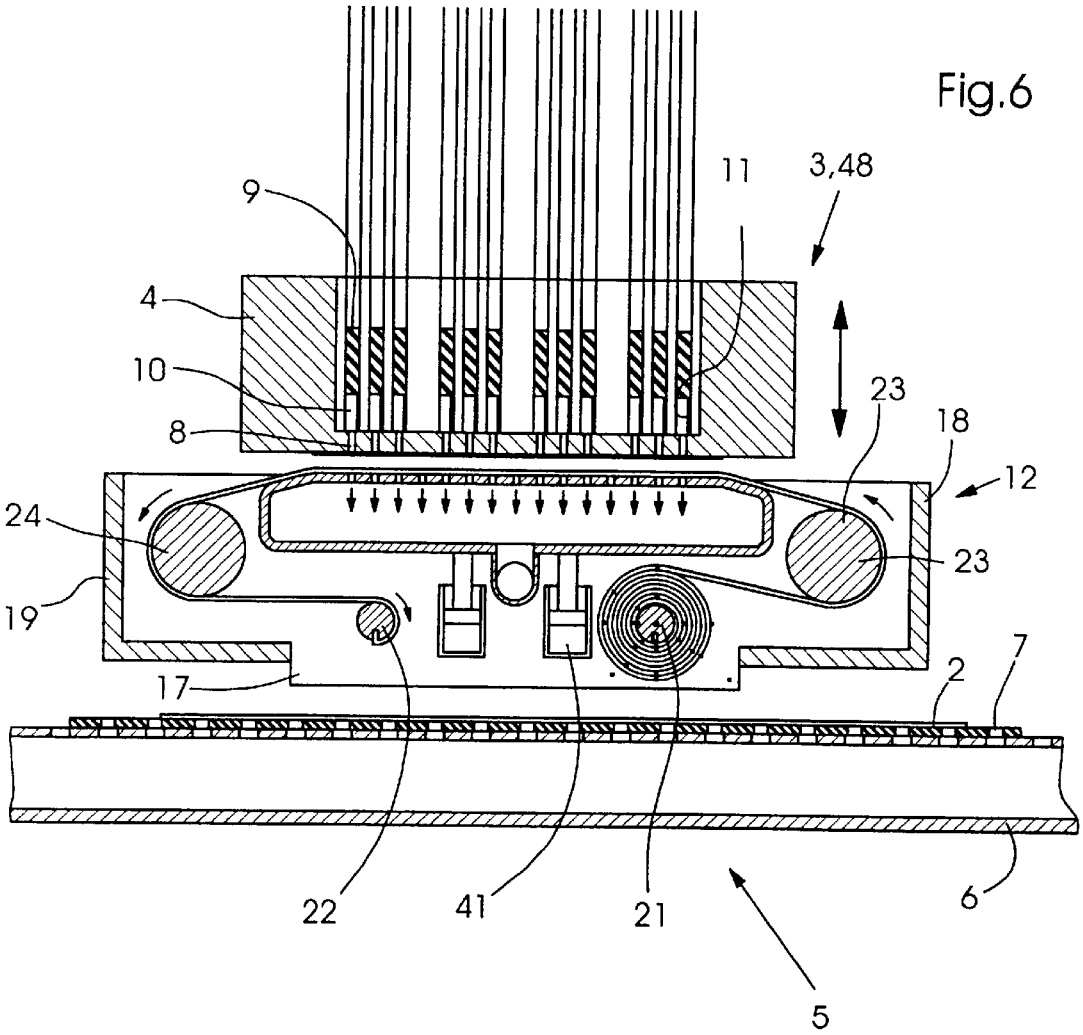
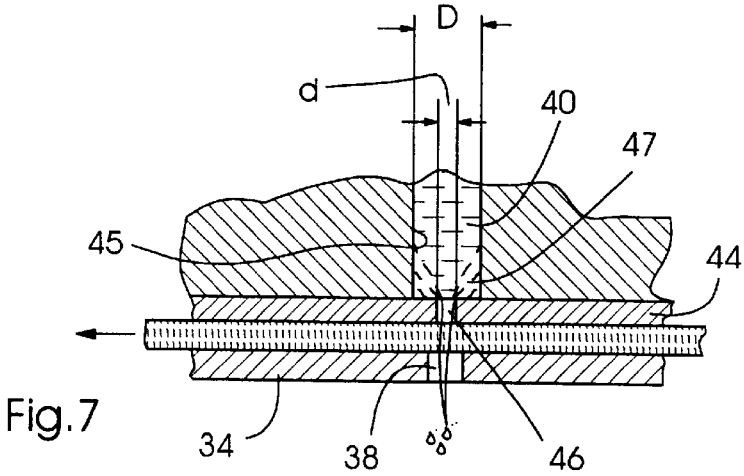
Fig.7

METHOD AND DEVICE FOR CLEANING A PRINT HEAD OF AN INK JET PRINTER

BACKGROUND OF THE INVENTION

Field of the Invention

The invention relates to a method for cleaning a print head of an ink jet printer by a cleaning tape, and to a device for cleaning a print head of an ink jet printer, including a cleaning tape and a suction device.

During relatively long printing pauses, thickening of the ink in the interior of the nozzles of an ink jet print head is possible and can result in disruptions when the printing operation is resumed. In order to prevent this from occurring, the nozzles are usually sprayed clear, as is also the case in an arrangement described in the published European Patent Document EP 0 389 481 B1. This heretofore known arrangement comprises a cleaning device with an endless tape and an ink droplet sensor with a suction block. The endless tape may be formed of rubber or an elastomer, and the suction block acts as a type of suction pump with a capillary effect. No provision has been made for removing ink nor is it technically possible to remove ink from the print head by using the suction block, which serves a quite different purpose. Spraying the nozzles clear requires the application of a positive pressure thereto, due to which small air bubbles which are caught in the corners within the nozzles are compressed in a detrimental manner and pressed still further into the corners, and are thus not released from the corners, which can lead to printing disruptions.

U.S. Pat. No. 5,730,538, and the published German Patent Documents DE 40 00 454 C2 and DE 197 04 003 A1 further describe the state of the prior art.

SUMMARY OF THE INVENTION

It is accordingly an object of the invention to provide a method for cleaning a print head by which printing disruptions are avoided, and to provide a device for performing the method effectively.

With the foregoing and other objects in view, there is provided, in accordance with one aspect of the invention, a method for cleaning a print head of an ink jet printer by a cleaning tape, which comprises sucking away printing ink from the print head by a suction device, and wiping or doctoring off the print head by the cleaning tape.

In accordance with another mode, the method of the invention includes simultaneously performing the sucking away of the printing ink from the print head, and the wiping or doctoring off of the print head.

In accordance with a further aspect of the invention, there is provided a method for cleaning a print head of an ink jet printer by a cleaning tape, which comprises sucking printing ink from the print head by a suction device onto the cleaning tape.

In accordance with an added mode, the method of the invention includes sucking the printing ink by the suction device out of the interior of at least one nozzle formed in the print head.

In accordance with an additional mode, the method includes sucking the printing ink by the suction device out of the interior of at least one nozzle formed in the print head.

In accordance with another aspect of the invention, there is provided a device for cleaning a print head of an ink jet printer, comprising a cleaning tape and a suction device, the cleaning tape being disposed between the print head and the suction device.

In accordance with a further feature of the invention, the cleaning tape rests both on the print head and on the suction device.

In accordance with an added feature of the invention, the cleaning tape is formed of air-permeable material.

In accordance with an additional feature of the invention, the cleaning tape is formed of absorbent material.

In accordance with an additional aspect of the invention, there is provided an ink jet printer in combination with a cleaning device having at least one of the foregoing features.

In accordance with yet another aspect of the invention, there is provided an ink jet printer, comprising a printing module and a cleaning module, the modules being of compatible construction, so that the cleaning module is optionally combinable with the printing module.

In accordance with yet a further aspect of the invention, there is provided an offset and/or rotary printing machine having integrated therein the ink jet printer with the foregoing features.

In accordance with a concomitant aspect of the invention, there is provided an offset and/or rotary printing machine coupled, for in-line operation, with the ink jet printer having the foregoing features.

The term "printing ink" used in connection with the invention includes both water-based inks and inks of a different composition, for example radiation-curing inks, so-called UV inks, which can be printed by the ink jet printer.

By the method according to the invention, very rapid cleaning of the print head is possible, during which the latter is cleaned mechanically with pneumatic assistance, and the printing ink can be removed from the nozzles by sucking out the printing ink from the print head according to the invention by the suction device, without spraying the nozzles clear.

In a mode of the method that is advantageous with regard to removing printing ink from a nozzle orifice and, simultaneously therewith, the cleaning of a nozzle outlet surface of the print head, the nozzle outlet surface is wiped off or doctored off by the cleaning tape while printing ink is being removed from the print head by the suction device.

In another mode of the method that is advantageous with regard to rapid storage in the cleaning tape of the printing ink removed from the print head, the ink is transferred from the print head to the cleaning tape by the suction device with the assistance of suction air.

In a further mode of the method that is advantageous with regard to the removal of air inclusions from the interior of the nozzle, the printing ink, together with the air included in the nozzle orifice, is sucked out of the nozzle orifice. Printing disruptions which are caused by small air bubbles in the interior of the nozzle and which manifest themselves by the absence of droplet ejection, are thus effectively prevented.

With the device according to the invention, the use of which is not exclusively restricted to the performance of the method according to the invention, the print head can be doctored off or wiped off, i.e., squeegeed, very thoroughly, specifically with pneumatic assistance for the transfer of ink from the print head to the cleaning tape.

In an embodiment of the cleaning device according to the invention that is advantageous with regard to hermetically sealing the area around a nozzle of the print head to which suction is to be applied by the suction device, the cleaning tape rests both on a nozzle outlet surface of the print head, wherein the nozzle terminates or opens, and also over the entire area of the suction device.

In an embodiment of the cleaning device that is advantageous with regard to sucking through the cleaning tape from the rear side thereof, as a result of which the printing ink is sucked onto the front side of the cleaning tape, the cleaning tape is permeable to air.

In an embodiment of the cleaning device that is advantageous with regard to the drip-free storage in the cleaning tape of the soiled or contaminated printing ink to be disposed of, the cleaning tape is formed of a textile or felt-like material.

The cleaning device according to the invention can be assembled from time to time with the ink jet printer for cleaning the print head of the latter. This is advantageous if the print head to be cleaned is comparatively heavy and consequently cannot be displaced or can be displaced only slightly in the horizontal plane for adjustment purposes.

The easily transportable cleaning module of the ink jet printer, which can be assembled and is of modular construction, is preferably constructed to correspond with the device according to the invention and can also be a cleaning device having a construction that differs therefrom and that is designed in an appropriately compatible manner that it can be assembled with the rest of the ink jet printer for the purpose of cleaning the print head.

The ink jet printer is preferably assigned to an offset printing machine, which can be a rotary printing machine, or to a rotary printing machine, which can be an offset printing machine, for combined operation as the impression or numbering unit thereof. With the printing machine, sheet printing material already printed in many colors can thus advantageously be additionally printed by the ink jet printer with individualized codes, for example changing bar codes, consecutive numbers or different recipient addresses.

Other features which are considered as characteristic for the invention are set forth in the appended claims.

Although the invention is illustrated and described herein as embodied in a method and device for cleaning a print head of an ink jet printer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the figures of the drawings, wherein:

BRIEF DESCRIPTION OF THE DRAWINGS

FIG. 6 is a longitudinal sectional view of the cleaning module shown in FIG. 5; and FIG. 7 is an enlarged fragmentary view of FIG. 6 showing a nozzle of the print head in detail.

DESCRIPTION OF THE PREFERRED EMBODIMENTS

Figure 1:
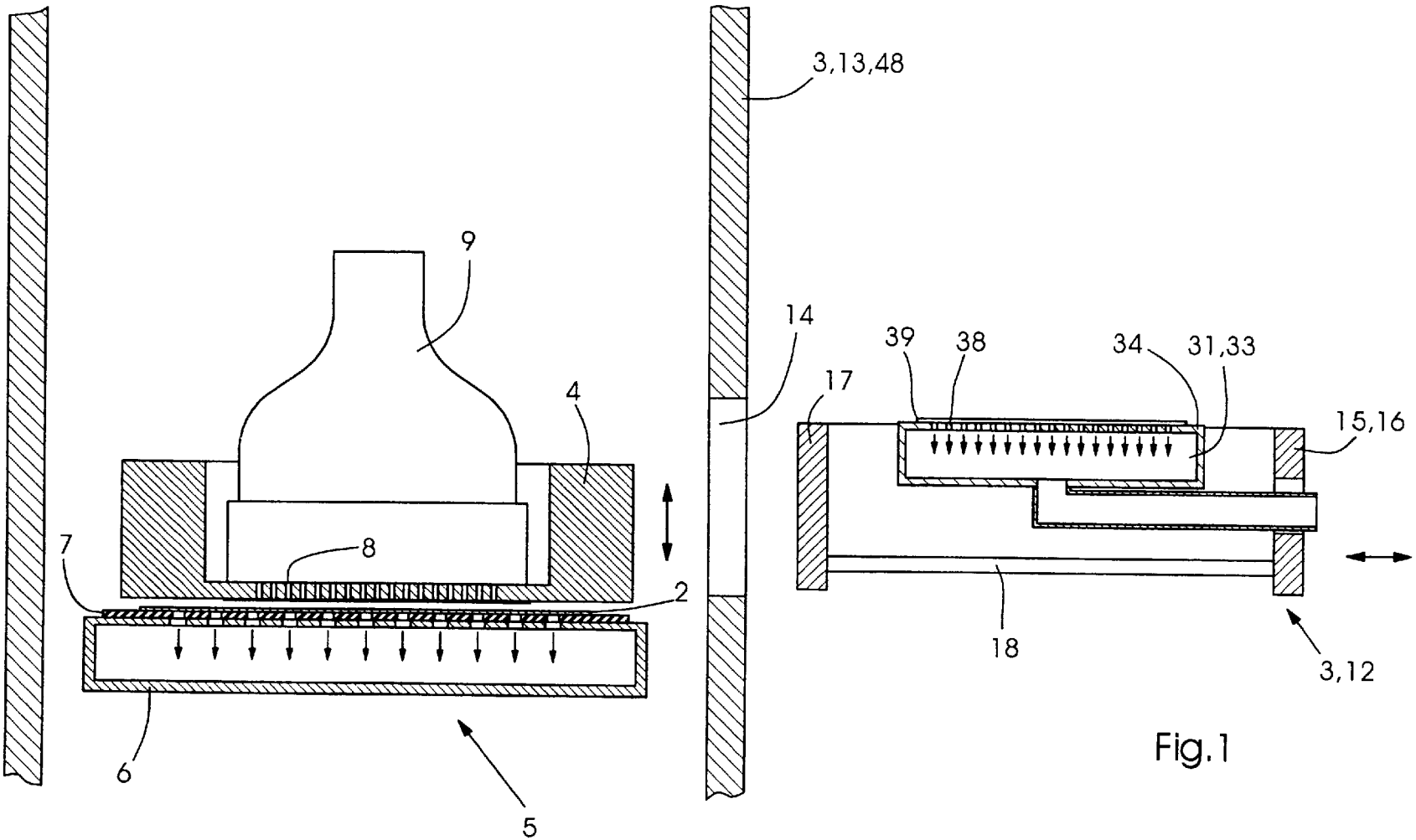
FIG. 1 is a diagrammatic cross-sectional view of an ink jet printer with a cleaning module withdrawn therefrom, and with a lowered print head.
Figure 2:
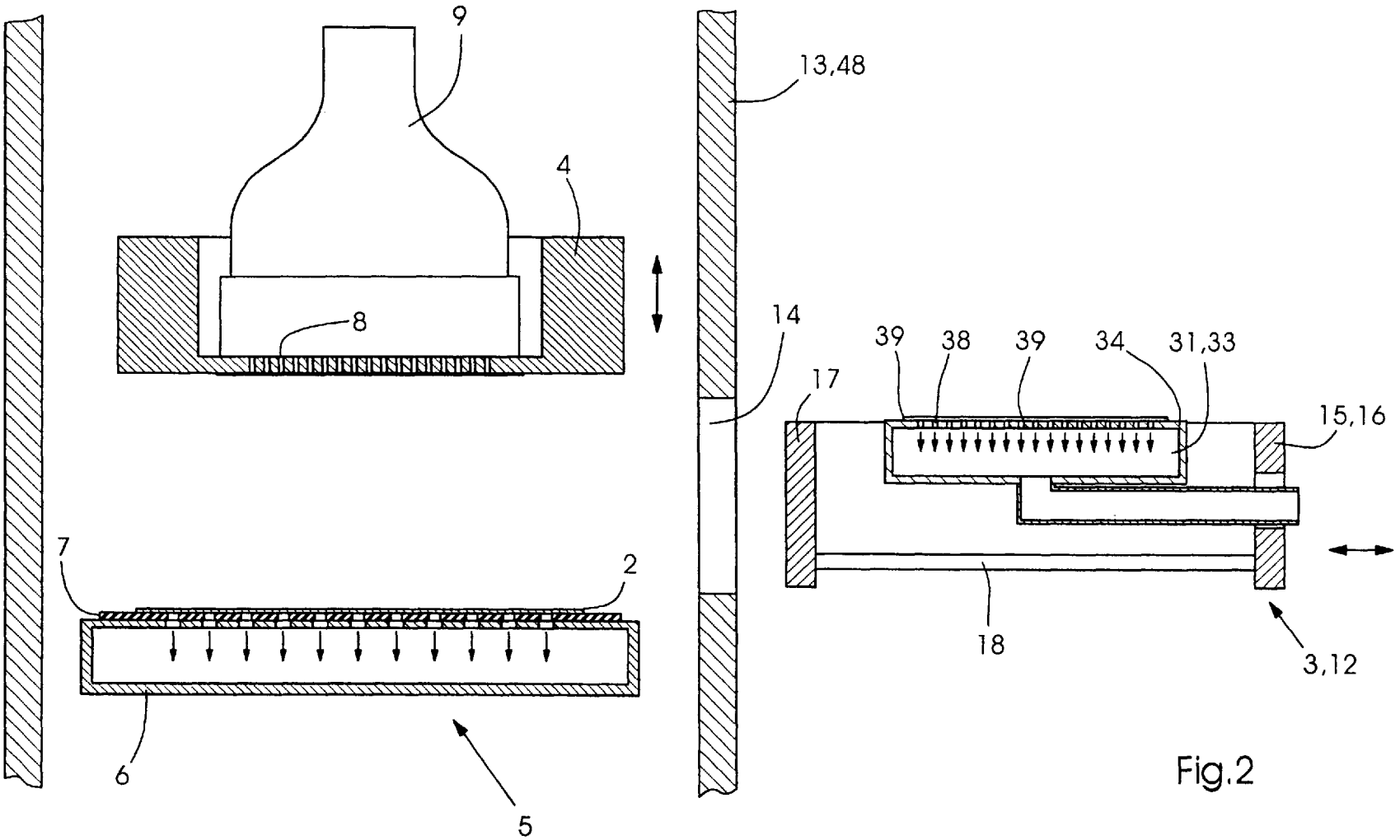
FIG. 2 is a view like that of FIG. 1 in another operating phase wherein the ink jet printer has a lifted print head.
Figure 3:
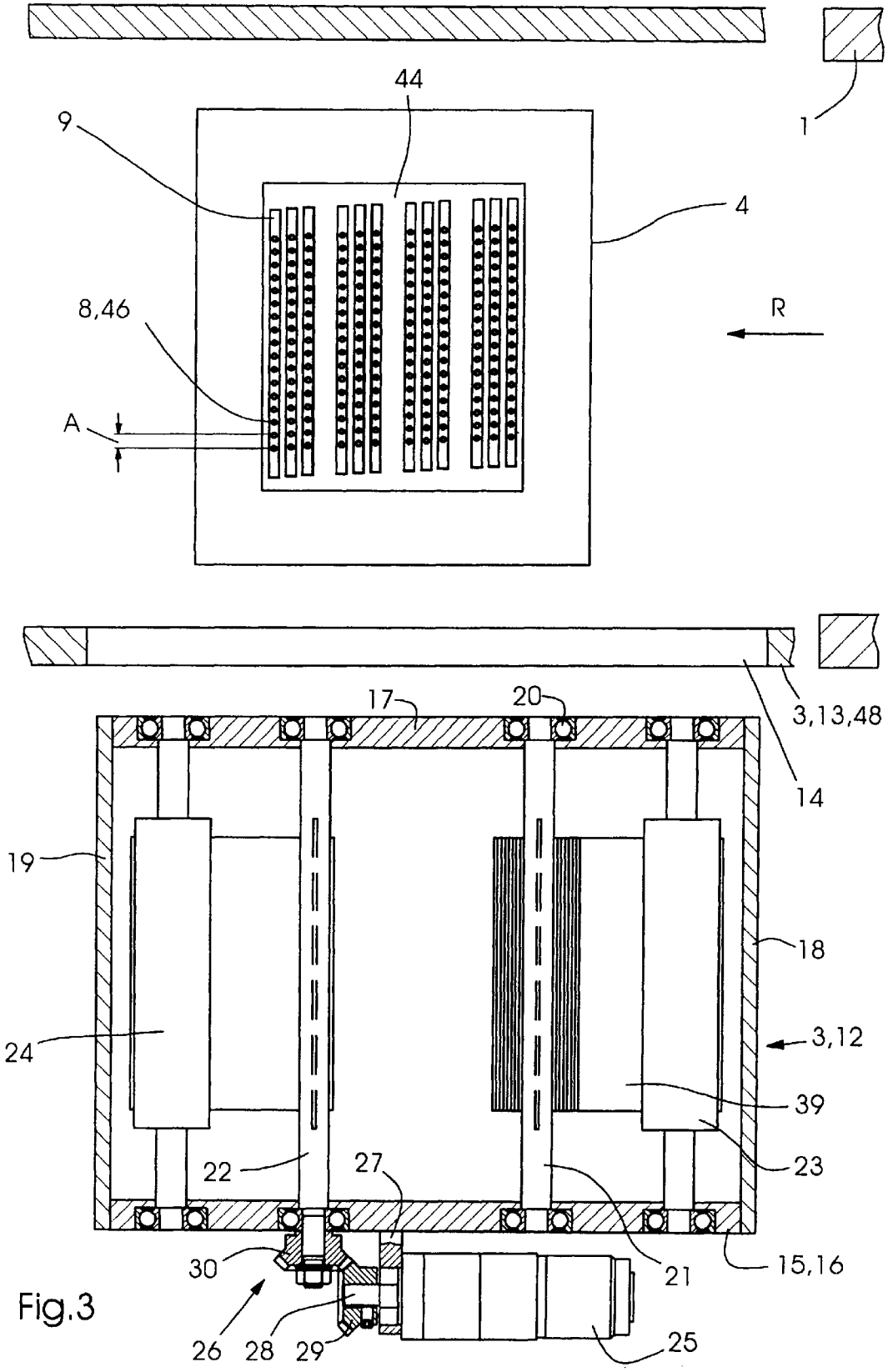
FIG. 3 is a fragmentary bottom plan view, partly in section and rotated through 180°, of FIG. 2, showing the ink jet printer with the print head and the cleaning module, and with the transport device omitted.
Figure 4:
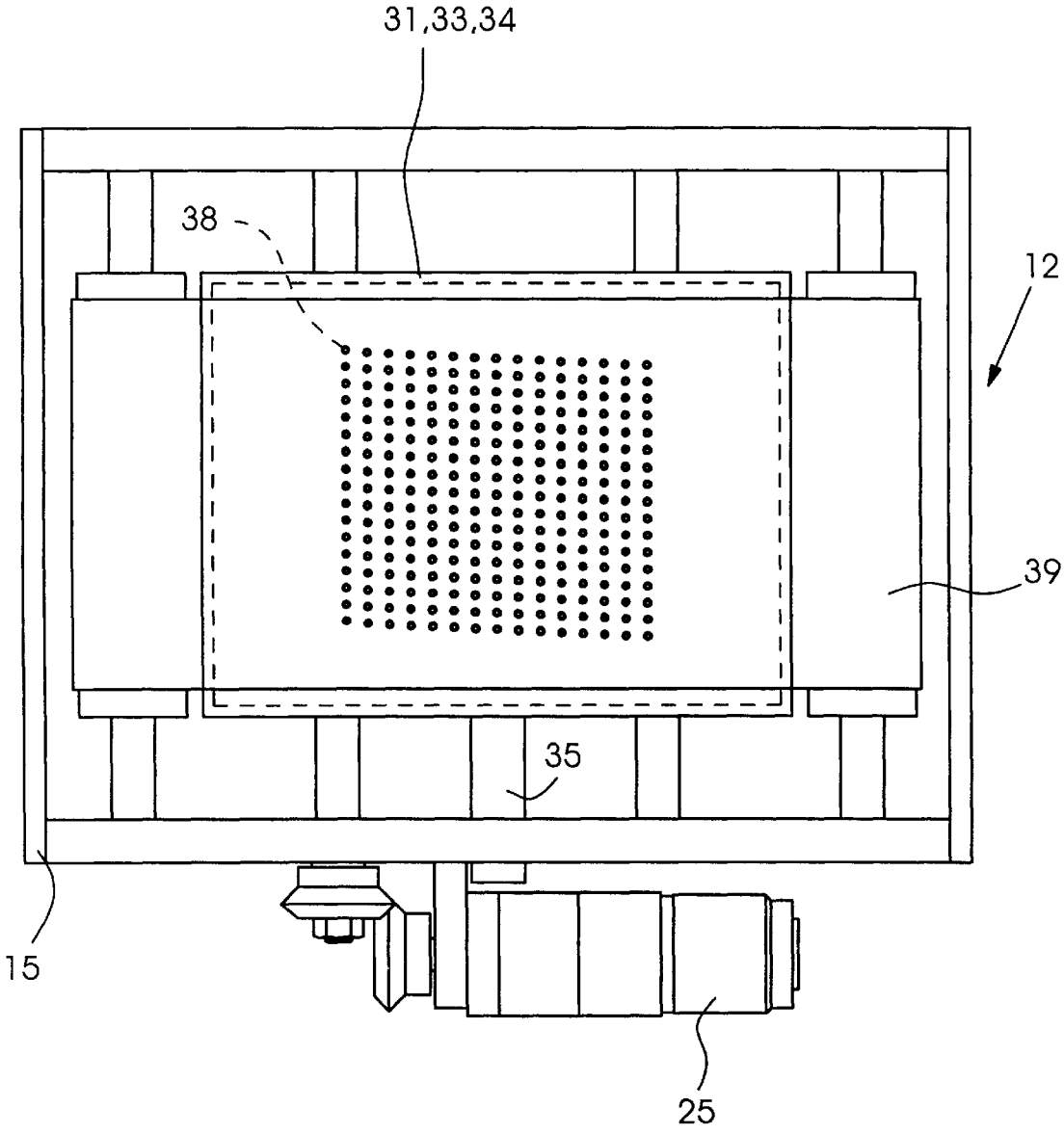
FIG. 4 is a slightly-enlarged fragmentary plan view of FIG. 3 showing the cleaning module.

Referring now to the drawing and, first, particularly to FIGS. 1 to 3 thereof, there is shown a printing machine 1, which is constructed as a rotary printing machine for printing sheet printing material 2 on the offset principle, having an ink jet printer 3 arranged downline therefrom, as viewed in the printing-material transport direction. A print head 4 of the ink jet printer 3 is selectively displaceable into a printing position (note FIG. 1) close to the printing material 2, or into a cleaning position (note FIGS. 2 to 6) drawn back from the printing material 2. A conveying device 5, which is constructed as a suction belt system, serves to transport the printing material from the printing machine 1 to the ink jet printer 3 and past the print head 4, which is disposed at the bottom of the latter. The suction belt system includes a suction table 6 and a revolving conveyor belt 7, which is guided over the suction table 6. The printing material 2 is sucked towards the conveyor belt 7 by suction through openings formed in the latter and, as a result, is firmly held in register on the conveyor belt 7, so that the printing material 2 can be printed by the print head 4 when the printing material 2 is located under the print head 4.

When the print head 4 is located in the printing position thereof, displaced towards the conveying device 5, as shown in FIG. 1, it is able to print the printing material 2 in accordance with an ink-jet principle referred to as "drop on demand", nozzles 8 in the print head 4 being activated in accordance with a printing image, so that droplets are ejected from each nozzle 8 only when they are to impinge upon the printing material 2 resting on the conveyor belt 7.

The print head 4 is composed of a number of nozzle modules 9, each of which includes a number of pump chambers 10 (note FIG. 6). Arranged in each pump chamber 10 is a piezoelectric element and, in particular, a piezoelectric film 11, which functions as a pump or pump actuator. Located at the end of each pump chamber 10 is one of the nozzles 8, from which the ink droplets are ejected. The nozzles 8 of each nozzle module 9 are arranged in a row at a constant distance A from one another (note FIG. 3). In order to achieve a high resolution, the nozzle modules 9 arranged behind one another in the printing-material transport direction R are, respectively, offset by one pixel relative to one another transversely with respect to the printing-material transport direction R. The distance A thus corresponds to the product of the number of nozzle modules multiplied by the pixel spacing.

Figure 5:
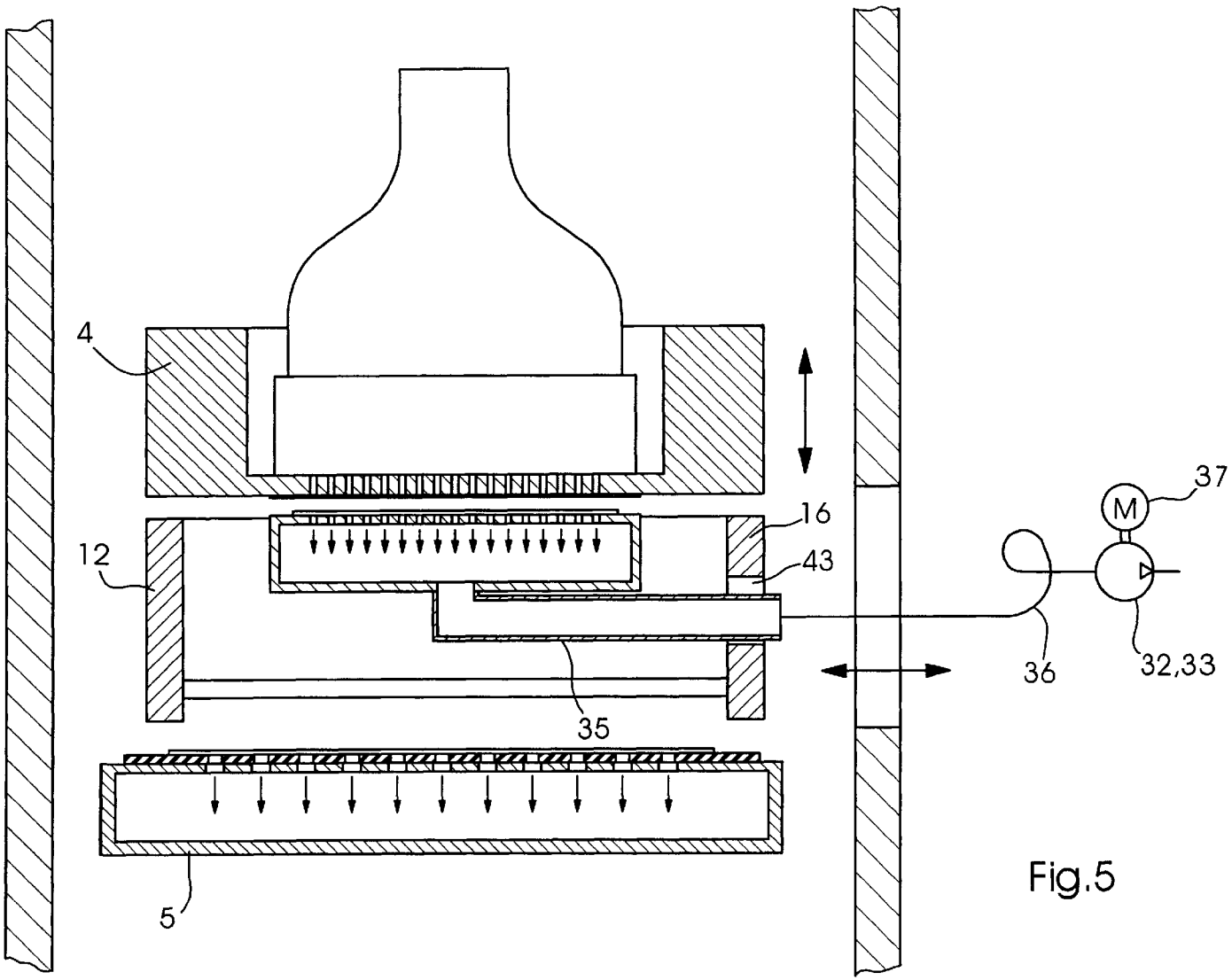
FIG. 5 is a view similar to that of FIG. 3 in another operating phase wherein the cleaning module is inserted into the ink jet printer in a transverse direction.

When the print head 4 is located in the cleaning position thereof, as shown in FIGS. 2 to 6, a cleaning module 12 can be displaced from a passive position thereof outside the ink jet printer 3, as shown in FIG. 2, into an active position thereof within the ink jet printer 3, as shown in FIG. 5. In order to make this possible, a window 14 has been cut out of one side wall 13 of the ink jet printer 3, the cleaning module 12 being insertable horizontally through the window 14 into the ink jet printer 3, between the print head 4 and the conveying device 5.

The cleaning module 12 has a frame 15, which is assembled from two plate-like longitudinal webs 16 and 17 and two transverse members 18 and 19, which are angular as viewed in profile (note FIG. 6). An unwinding roller 21, a rewinding roller 22 and two deflection rollers 23 and 24 are rotatably mounted in the frame 15, via pivot bearings 20 formed as ball or roller bearings. An electric motor 25 for rotatably driving the rewinding roller 22 via a gear transmission 26 in the form of a bevel gear mechanism is fixed to the frame 15 via a bracket 27. The motor 25 is fixed to the frame 15 on that side of the cleaning module 12 which is directed towards the window 14 when the cleaning module 12 is located in the active position thereof, as shown in FIG. 5. The bracket 27 holds the motor 25 in a manner that the motor shaft thereof is at right angles to the rewinding roller 22. A bevel gear 29 seated on the motor shaft 28 so as to be fixed against rotation relative thereto meshes with a bevel gear 30 that is seated on the rewind roller 22 so as to be fixed against rotation relative thereto.

A further constituent of the cleaning module 12 is a suction device 31, which includes a vacuum generator 32 (note FIG. 5) constructed as a pneumatic suction pump, and a box-like suction chamber 33 with a suction plate 34, to which vacuum can be applied by the vacuum generator 32. The suction chamber 33, disposed between the longitudinal webs 16 and 17 and between the transverse members 18 and 19, is connected to the vacuum generator 32 via a connecting pipe 35 that projects out of the frame 15, and a flexible hose 36, the vacuum generator 32 being driven by an electric motor 37. The connecting pipe 35 extends from the center of the suction chamber 33 through the longitudinal web 16 in the direction of that side of the cleaning module 12 which is directed towards the window 14 when the cleaning module 12 is in the active position thereof, as shown in FIG. 5. The suction plate 34, forming one wall of the suction chamber 33, is provided with suction openings 38 which are arranged in rows and in a grid pattern corresponding to that of the nozzles 8.

A cleaning tape 39 formed of air-permeable fleece is fixed to one end of the tape on the unwinding roller 21, and to the other end of the tape on the rewinding roller 22 and, for example, is clamped in or suspended from the winding rollers 21 and 22. The cleaning tape 39 is guided from the unwinding roller 21, over the deflection roller 23, over the suction chamber 33 and over the deflection roller 24, in the aforementioned sequence, to the rewinding roller 22. The unwinding roller 21 serves for storing the section of the cleaning tape 39 that is clean and not yet impregnated with the printing ink 40, and the rewinding roller 22 serves for storing the section of the cleaning tape 39 that is soiled or contaminated, until it is disposed of as disposable and consumable material, respectively.

The suction chamber 33 and, together therewith, the suction plate 34 are mounted in the frame 15 so that they can be displaced in the vertical direction towards and away from the print head 4. In order to displace the suction chamber 33 and the suction plate 34 in this manner, there is provided at least one actuator 41, which can be a reciprocating-piston cylinder to which a compressed fluid can be applied, for example, a pneumatic reciprocating-piston cylinder. It is preferable if at least two such reciprocating-piston cylinders are provided. When the actuator 41 lifts the suction plate 34, the cleaning tape 39 guided over the latter is pressed against a nozzle outlet surface 42 on the print head 4. The connecting pipe 35 has sufficient clearance within a window 43 (note FIG. 5) formed in the side wall 16, which for example can be dimensioned as a slot extending longitudinally in the vertical direction, so that the connecting pipe 35 can move within the window 43, following the displacement of the suction chamber 33.

The nozzle outlet surface 42 is part of a very thin nozzle plate 44 that is fixed to the print head 4. One and the same strand or run of the cleaning tape 39 rests on the nozzle outlet surface 42 both with the front side thereof, which is the wiping surface, and with the rear side thereof on the suction device 31 and, to be precise, on the suction plate 34 thereof.

The nozzle orifice diameter D (note FIG. 7) of each nozzle orifice 45 incorporated into the print head 4 is, for example, about 500 $\mu$m and is therefore much greater than the nozzle opening diameter d of each nozzle opening 46 incorporated into the nozzle plate 44, which can be, for example, about 20 $\mu$m. With the nozzle openings 46 thereof, the nozzle plate 44, on the underside of which the nozzle outlet surface 42 is located, thus partially closes the nozzle orifices 45 in the manner of an aperture stop.

It has been found that one or more small air bubbles 47 can form in the corners between the nozzle plate 44 and the nozzle orifice 45 and can lead to disruptions to the printing and cannot be removed by spraying the nozzles 8 clear, for example as proposed in the published European Patent Document EP 0 389 481 B1. Much more beneficial is the application of a vacuum to the nozzle orifice 45, as a result of which the small air bubble 47 expands, as represented by the broken lines in FIG. 7. The small air bubble 47 cannot collect in the corner and is instead drawn in the direction of the nozzle opening 46 and out of the latter, as a result of which the printing ink 40 can subsequently flow into the corner.

The functioning of the illustrated system is as follows:

The sheet-like printing material 2 lying flat on the surface of the conveying device 5 is printed under the print head 4 by the latter. In the process, the print head 4 is lowered very close to the conveying device 5 and the printing material 2 transported past the print head 4 by the conveying device 5, and the print head 4 ejects droplets of printing ink from the nozzles 8 thereof. In order to eject droplets from each nozzle 8, the pump chamber 10 thereof is activated, by a voltage that is applied to the piezoelectric film 11 arranged in the respective pump chamber 10, so that the piezoelectric film 11 deforms in the direction of the interior of the nozzle and consequently expels the printing ink 40 located therein, as a droplet from the nozzle 8.

During this printing operation (note FIG. 1), the cleaning module 12 belonging to the ink jet printer 3 is deposited outside the ink jet printer 3. In order to remove from the nozzle outlet surface 42 any printing ink 40 which has been smeared onto the nozzle outlet surface 42 by the printing material 2, or has seeped out of the nozzles 8 onto the nozzle outlet surface 42, and in order to remove small air bubbles 47 from the interior of the nozzles 8 and to prevent the formation of air inclusions in the interior of the nozzles 8, respectively, it is advantageous to clean the print head 4 at regular intervals, using the cleaning module 12, for which purpose the cleaning module 12 is assembled with the remaining ink jet printer 3, i.e., the printing module 48.

For this purpose, the print head 4 is placed at a very great distance from the conveying device 5, as can be seen in FIG. 2, so that the cleaning module 12 can be displaced in the horizontal direction, transversely with respect to the printing-material transport direction R, past the side wall 13 or through the latter into the interspace formed between the print head 4 and the conveying device 5. This can be done by providing for the operating personnel to place the cleaning module 12 onto a guiding device, for example onto a guide rail, and to insert the cleaning module 12 into the printing module 9 along the latter.

After this has been done, and the cleaning module 12 is located in the printing module 48 (note FIGS. 5 and 6), there remains a clearance between the cleaning tape 39 and the nozzle outlet surface 42 (note FIG. 5) which can be bridged by lowering the print head 4, as a result of which the nozzle outlet surface 42 is seated on the cleaning tape 39. However, in order to bridge the clearance, the cleaning tape 39 is preferably lifted towards the nozzle outlet surface 42 by the actuator 41 and, covering the nozzles 8, is pressed against the nozzle outlet surface 42, as can be seen in FIG. 6.

Before or after the production of the contact between the cleaning tape 39 and the nozzle outlet surface 42, the motor 25 is switched on, as a result of which the rewinding roller 22 (note FIG. 6) begins to rotate in a clockwise direction, and draws the cleaning tape 39 slowly over and in contact with the suction plate 34 in the printing-material transport direction R. It is equally well possible for the cleaning tape 39 to run counter to the printing-material transport direction R. With regard to non-illustrated embodiments, it is also conceivable for the cleaning tape 39 to run transversely to the printing-material transport direction R. During the wiping operation, the cleaning tape 39 runs continually past the nozzle outlet surface 24, the latter being wiped off thoroughly by the cleaning tape 39 which rubs along it in the process. It is not only the printing ink 40 located on the nozzle outlet surface 42, but also other soil or contaminants possibly mixed with the printing ink 40, for example paper dust, which are removed from the nozzle outlet surface 42 by the cleaning tape 39. The cleaning tape 39 is unwound in the clean state from the unwinding roller 21, which rotates in a clockwise direction, as viewed in FIG. 6, so that clean regions of the tape come continuously into contact with the nozzle outlet surface 42.

The aforedescribed mechanical cleaning of the print head 4 can be assisted pneumatically by the suction device 31 during the entire duration of the cleaning operation. In this case, the vacuum generator 32 is activated before or at the same time as the motor 25 and deactivated after or at the same time as the motor 25. However, multiphase cleaning of the print head 4 is also possible, the latter being cleaned both mechanically and pneumatically in one cleaning phase and only mechanically in a subsequent cleaning phase. In this case, provision can be made for the suction device 31 to be deactivated during the wiping action, while the cleaning tape 39 continues to run.

The vacuum prevailing in the suction chamber 33 when the vacuum generator 32 is active is transmitted through the suction openings 38, and the cleaning tape 39 covering the latter, into the nozzle orifices 45 in the nozzles 8.

To this end, the suction openings 38 are arranged in such a manner, and the cleaning module 12 is positioned in the cleaning position thereof (note FIG. 6) in such a manner that the suction openings 38 cover the nozzle openings 46 in the nozzles 8. It is preferable for each nozzle 8 to have a corresponding suction opening 38 assigned thereto, which is aligned with the nozzle 8 during the cleaning operation. However, provision can also be made for one suction opening 38 to cover a number of nozzle openings 46 at the same time.

When the print head 4 has been cleaned, the suction chamber 33 and the suction plate 34 therewith are lowered away from the print head 4 again by the actuator 41, and the motor 25 is switched off, the action of switching off the advance of the cleaning tape being preferably performed following the production of the clearance between the revolving cleaning tape 39 and the nozzle outlet surface 42, i.e., after the lowering action.

After the cleaning operation, the cleaning module 12 can be removed from the printing module 48, an action which is performed in a manner opposite to that occurring during the assembly thereof. The print head 4 is then displaced again, towards the conveying device 5, into the printing position thereof (note FIG. 1) after which the previously deactivated expulsion of ink from the print head 4 during the cleaning operation is reactivated, so that the printing material 2 fed to the ink jet printer 3 from the printing machine 1 can again be provided with personalized imprints or the like in the ink jet printer 3. In the printing machine 1, the printing material 2 is provided with a four-color or multicolor printed image, to which the imprinted image is added. For example, a different recipient address, to which the printed material 2 is to be sent after the printed material 2 has been further processed to form a brochure, is printed by the ink jet printer 3 onto each of the sheets of printing material 2, for example, conveyed after one another to the ink jet printer 3 by the conveying device 5.

I claim:

1. A method for cleaning a print head of an ink jet printer with a cleaning tape, which comprises sucking away printing ink from the print head with a suction device, and simultaneously wiping or doctoring off the print head with the cleaning tape.

2. The method according to claim 1, which includes sucking the printing ink by the suction device out of the interior of at least one nozzle formed in the print head.

3. A method for cleaning a print head of an ink jet printer by a cleaning tape, which comprises sucking printing ink from the print head by a suction device onto the cleaning tape.

4. The method according to claim 3, which includes sucking the printing ink by the suction device out of the interior of at least one nozzle formed in the print head.

5. The method according to claim 3, wherein the step of sucking the printing ink includes sucking the printing ink through the cleaning tape.

6. A device for cleaning a print head of an ink jet printer, comprising a cleaning tape and a suction device, said cleaning tape being disposed between the print head and said suction device.

7. The device according to claim 6, wherein said cleaning tape rests both on the print head and on said suction device.

8. The device according to claim 6, wherein said cleaning tape is formed of air-permeable material.

9. The device according to claim 6, wherein said cleaning tape is formed of absorbent material.

10. An ink jet printer in combination with the cleaning device according to claim 6.

11. An offset and/or rotary printing machine with the ink jet printer according to claim 10 integrated therein.

12. An offset and/or rotary printing machine coupled, for in-line operation, with the ink jet printer according to claim 10.

13. An ink jet printer, comprising:

a printing module; and a cleaning module for cleaning said printing module;

said modules being of compatible construction, so that said cleaning module is optionally combinable with said printing module;

said cleaning module including a cleaning tape and a suction device, said cleaning tape being disposed between said printing module and said suction device.

* * * * *